US005230123A

United States Patent [19]

Williams et al.

[11] Patent Number: 5,230,123

[45] Date of Patent: Jul. 27, 1993

[54] OPERABLE WALL DEPLOYMENT AND STORAGE SYSTEM

[75] Inventors: Charles E. Williams, Delavan; Karl F. Arps, Monona, both of Wis.

[73] Assignee: Hufcor, Inc., Janesville, Wis.

[21] Appl. No.: 818,409

[22] Filed: Jan. 3, 1992

Related U.S. Application Data

[63] Continuation of Ser. No. 454,151, Dec. 21, 1989, abandoned.

[51] Int. Cl.[5] ..... A47H 1/04; E05D 15/26

[52] U.S. Cl. ..... 16/95 R; 49/127

[58] Field of Search ..... 49/127; 16/87 R, 87.4 R, 16/95 R

[56] References Cited

U.S. PATENT DOCUMENTS

| | | | |
|---|---|---|---|
| 2,657,436 | 11/1953 | Fairhurst et al. | 49/127 |
| 3,241,197 | 3/1966 | Gogerty | 49/127 |
| 3,334,375 | 8/1967 | Hubbard | 49/127 |
| 4,555,828 | 12/1985 | Matimura | 16/95 R |
| 4,569,164 | 2/1986 | Dickson | 49/127 |
| 5,016,318 | 5/1991 | Harris | 16/95 R |

FOREIGN PATENT DOCUMENTS

| | | | |
|---|---|---|---|
| 875929 | 5/1953 | Fed. Rep. of Germany | 49/127 |
| 13652 | of 1897 | United Kingdom | 49/127 |

*Primary Examiner*—John Sipos
*Assistant Examiner*—Carmine Cuda
*Attorney, Agent, or Firm*—Michael, Best & Friedrich

[57] ABSTRACT

A system of movable panels supported from overhead tracks by carriers engaged in the tracks. The panels are movable between a storage area and operable positions by moving the carriers along the tracks. The tracks are provided with an arrangement of bars which are selectively positioned at the junction between angularly related track sections. These bars, in cooperation with a preselected portion or portions of the carriers, permit only certain panels to move from one track section into another and blocking the entry of others. In addition, an arrangement of diverters are selectively positioned in the track sections in the area of the junction between track sections. These diverters, in cooperation with a preselected portion, or portions, of the carriers prevent certain panels from continuing along a given track section and divert those panels into an adjacent, angularly related track section.

9 Claims, 2 Drawing Sheets

OPERABLE WALL DEPLOYMENT AND STORAGE SYSTEM

This is a continuation of application Ser. No. 07/454,151, filed Dec. 21, 1989, now abandoned.

BACKGROUND OF THE INVENTION

This invention relates to multi-directional suspension systems for operable walls or partitions and, more particularly, to a suspension track arrangement for automatically orienting such operable walls for storage and/or deployment.

Where large spaces are intended to be temporarily subdivded into smaller rooms in, for example, hotels, clubs, convention halls, and the like, usually a partition suspension system is provided which permits movement of subdividing walls or panels between a storage area and the point of intended use, the storage area being removed from the space to be subdivided. These systems for deployment and storage involve an overhead track grid arrangement, commonly made up of straight sections of track and lateral track sections which form, with the straight sections, right angle turns, cross-overs, and T-intersections, these being interspersed along the straight track sections.

In some situations, the subdivided areas may require a particular type of panel. For example, a fire-rated panel may be required when forming a corridor or a sound-rated panel may be required in designated areas. Furthermore, it is often desirable to insure that the panels are stored with a particular orientation so that they can be moved directly from storage to their operable positions without first requiring manipulation for proper orientation. In some instances, this can require careful attention to positioning of the panels in storage as well as in use.

SUMMARY OF THE INVENTION

Among the general objects of this invention is to provide a track and carrier system which automatically positions the partitions for storage in a desired orientation.

Another general object of this invention is to provide a track grid system which will automatically sort panels to insure that only a particular type of panel can be moved into a given operable position.

A still further general object of this invention is to provide such attributes in a track grid system which is simple and cost effective.

For the achievement of these and other objects, this invention contemplates a combination overhead grid track system and partition carriers. That is, the panels are supported from carriers which are positioned in and roll along the grid track system.

The grid track system is made up of what will be termed main track runs and lateral track runs. The lateral track runs extend from the main tracks but open into the main tracks so that the carriers which are attached to operable wall can move selectively between the main and lateral track runs. To accomplish the selective movement between track runs, the combination of obstructions in the main and lateral track runs with preselected carrier configurations insures the proper orientation of the panels for storage and/or the acceptance of only a preselected type of panel for operative positioning in a given track section.

Preferably, this is accomplished by providing the operable wall carrier with a projection which travels in the track runs with the carrier. An obstruction is positioned in the main track run and in the path of travel of the projection on the carrier. The obstruction is positioned in the area where the lateral track run opens into the main track run, and when the carrier projection engages the obstruction, the carrier is diverted into the adjacent, lateral track run. The lateral track run into which that carrier is diverted, also includes an obstruction in the carrier path. The carrier diverted into the lateral run is further configured so that it clears the second obstruction and then can run freely into and through the lateral track run. The configuration which clears the obstruction in the lateral track run is provided on selective carriers which also include the diverter engaging projection. Others of the carriers are not so configured so that they will not clear the obstruction in the lateral track run and, thus, are prevented from entering the lateral track run.

These and other objects and advantages of the invention will be pointed out in, or be apparent from, the specification and claims, as will obvious modifications of the embodiments shown in the drawings.

DESCRIPTION OF THE PREFERRED EMBODIMENT

Figure 1:
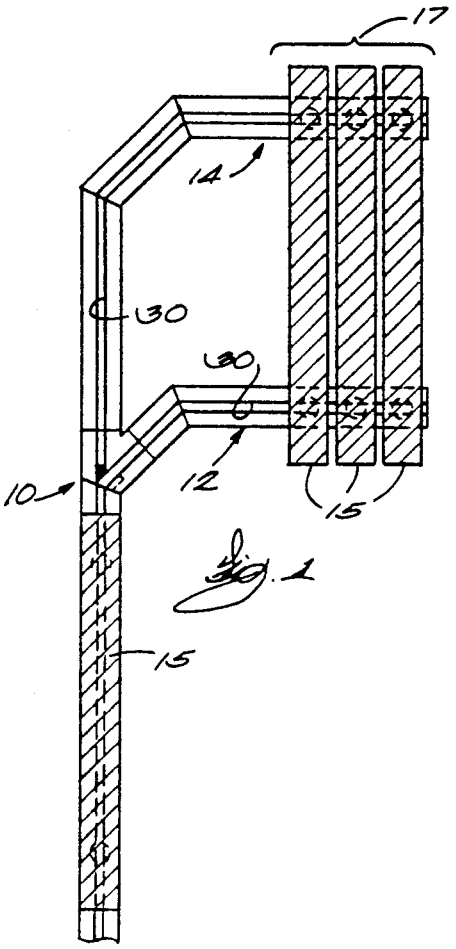
FIG. 1 is plan view of a portion of a track grid system illustrating how the operable partitions or walls are stored.

With reference to the drawing, particularly FIG. 1, a ceiling grid track pattern or system is shown as being made up of track runs 10, 12 and 14. A number of portable partitions or walls 15 are suspended from the grid track system. The track system is viewed from below with walls 16 superimposed on the tracks and highlighted by shading, but illustrated in various positions which they can occupy. Slots 30 are illustrated and will be described more completely hereinafter. It will be appreciated slots 30 extend the length of the tracks, but have not been shown where the walls are superimposed.

It is generally conventional to store the walls 15 in a stacked relation in a remote area 17. The walls are moved out of the storage area along lateral track runs 12 and 14 and then moved to their operative positions along track run 10. The operative positions are locations where room dividers are required. At those positions, the walls are suspended from track run 10 or from additional lateral track runs similar to track runs 12 and 14 but usually at right angles to the track runs 10. This deployment of the walls is illustrated in part in FIG. 9 and will be described more completely hereinafter. The walls are returned to storage along the track run 10 and through lateral track runs 12 and 14.

Figure 2:
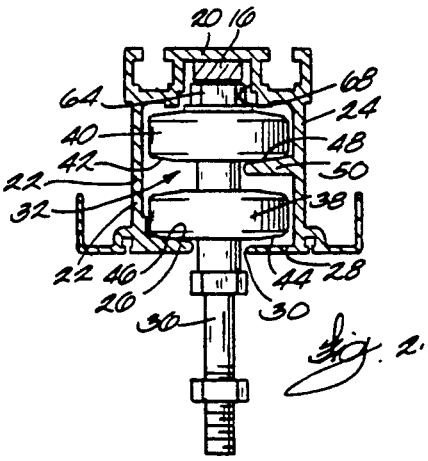
FIG. 2 is a view, partially in section, illustrating one of the operable wall carriers engaged in one of the track runs.
Figure 3:
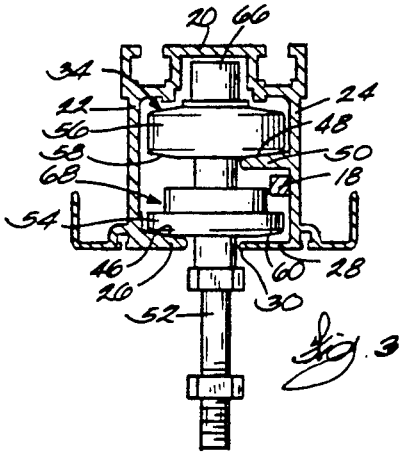
FIG. 3 is view, partially in section, of another of the carriers engaged in another of the track runs.

The support carriers for the walls are illustrated in FIGS. 2 and 3. Track runs 10, 12 and 14 have the same configuration with the exception of projections 16 and 18. Therefore, corresponding elements in FIGS. 2 and 3 will be identified by the same numbers, track run 10 being illustrated in FIG. 2 and track run 12 being illustrated in FIG. 3.

The tracks include an upper wall 20 and depending side walls 22 and 24. The lower ends of the side walls carry opposed ledges 26 and 28 which terminate in spaced relationship to define slot 30. The upper wall and side walls define an interior space and carriers 32 and 34 are positioned in that space. The carriers have different constructions and those differences will be explained hereinafter.

Looking first at FIG. 2, carrier 32 includes a pendant bolt 36 which extends downwardly through slot 30. The lower end of bolt is threaded for attachment to the actual movable partition or wall (not shown in FIG. 2). A pair of discs 38 and 40 are journaled on the bolt 36 for rotation about the bolt. The underside of each disc has an angled surface 42 and 44 extending completely around the discs 38 and 40. Those angled surfaces 42 and 44 engage upwardly facing, preferably similarly angled surfaces 46 and 48. One angled surface 46 is part of ledge 26. Angled surface 48 is part of ledge 50 projecting from wall 24, but is spaced horizontally and vertically from ledge 26. With this arrangement, there is clearance for bolt 36 and discs 38 and 40 roll on ledges 26 and 50 in moving along the track.

Turning now to FIG. 3, carrier 34 also includes a pendant bolt 52 extending through slot 30 for connection to an operable wall. Two discs 54 and 56 are journaled on bolt 52, with the undersides thereof having angled surfaces 58 and 60 engaged with the angle surfaces 46 and 48 in the track in the same manner and for the same reasons as set forth in connection with FIG. 2.

To this point, the carrier and track structure is generally along the lines of the arrangement disclosed and claimed in U.S. Pat. No. 3,879,799 which is assigned to the assignee of this application.

Continuing with reference to FIG. 2, 3 and 4, the difference in construction between carriers 32 and 34 and the reasons for that difference will now be explained.

Figure 4:
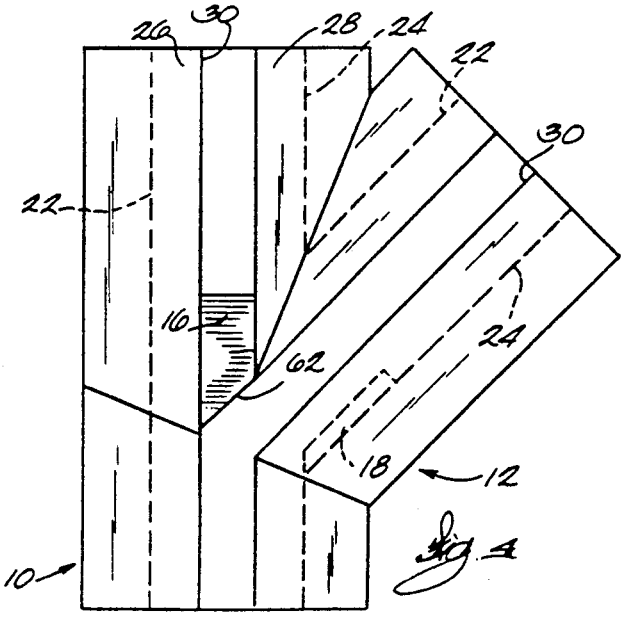
FIG. 4 is an enlarged plan view of the track runs at the point where the lateral track run opens into the main track run.

FIG. 4 illustrates a portion of track run 10 in the area where track run 12 extends laterally from track run 10, but opens into track run 10 so that there is open communication for passage of the carriers between track runs 10 and 12. Track run 14 also opens into track run 10 for transfer of carriers therebetween.

One of the objects of this invention is to provide a system which will automatically position the partitions for storage in a desired orientation. This is accomplished by preventing entry of the carriers into the lateral track runs for storage unless the partitions are properly oriented.

More specifically, bar 16 is attached to upper wall 20 of track run 10. As can be seen in FIG. 4, this bar is positioned in the area at which lateral track run 12 opens to the track run 10. The forward facing surface 62 is angled and positioned generally in alignment with slot 30 in track run 12. Carrier 32 extends upwardly but the head 64 of bolt 36 will ride under bar 16. In contrast, bolt 52 includes an upper extension, projection 66, which extends above the uppermost disc 56 into the recess 68 provided in wall 20. Projection 66 is preferably in the form of a roller journaled on the end bolt 52. Bar 16 is in the path of movement of projection 66 in track run 10. When projection 66 engages surface 62 of bar 16, carrier 34 is diverted into track run 12.

For convenience and clarity of illustration, carrier 34 is shown in track run 12 after it has been diverted and carrier 32 is illustrated in track run 10 as it clears bar 16.

It will also be noted that disc 54 of the carrier has a dimensionally reduced portion in the axial direction or thickness of the disc, as compared to disc 56 and, more importantly, disc 38. This attributes a cut-out 68 to the upper side of disc 34 which, when the disc 34 is in track run 12, clears bar 18. Since recess 68 in track run 12 is open and free of bar 16 and with disc 34 clearing bar 18, the carrier 34 is free to enter and move along track run 12 until it reaches a storage position.

In contrast, disc 38 of carrier 32, which occupies the same relative position in carrier 32 as disc 54 in carrier 34, does not include a cut-out or relief portion 68. When carrier 32 is at the entrance to lateral run 12, there will be interference between disc 38 and bar 18 which prevents carrier 32 from entering the lateral track run 12. However, carrier 32, as can be seen in FIG. 2, is free to run in track run 10 until it reaches lateral track run 14. Lateral track run 14 is free of any projection such as 18 and carrier 32 can be moved into a storage position.

With this construction, a carrier 32 is positioned in the leading direction relative to partition movement along track run 10 toward a storage position. Carrier 34 is positioned in a trailing position. When moving into storage, carrier 32 passes lateral track run 12 and reaches lateral track run 14 at the time carrier 34 reaches lateral track run 12. Carrier 34 is diverted into lateral track run 12 and the partitions are then stored in what is commonly referred to as parallel stacked relationship, i.e., parallel to each other and to track run 10. The partitions are stored in a preselected orientation as determined by the leading and trailing carriers.

Figure 5:
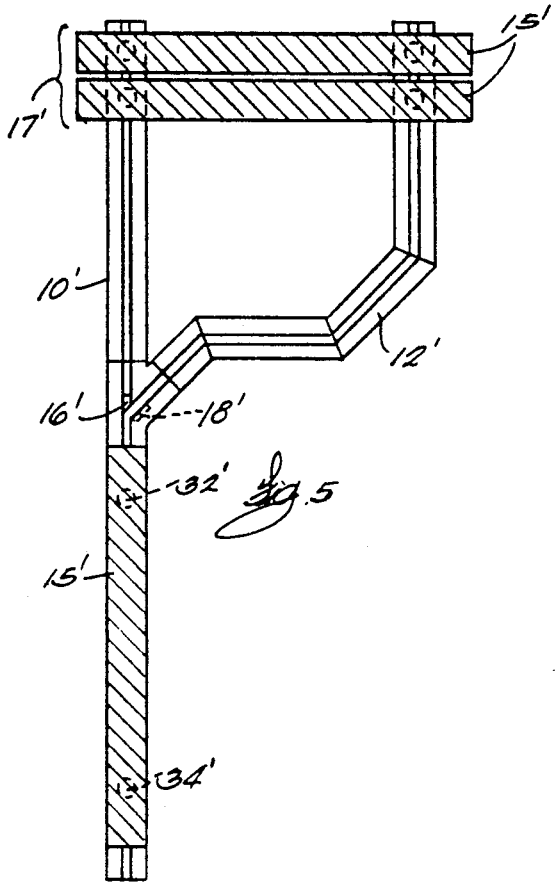
FIG. 5 is a plan view of an alternative storage arrangement provided by a grid track system.

FIG. 5 illustrates what is commonly referred to as a side stack storage arrangement. Here only one lateral track run 12' is used and track run 10' extends all the way to the storage area 17'. The carriers 32' and 34' are illustrated schematically by the shaded circles as they were in FIG. 1. Carrier 32' passes under bar 16' and bar 18' prevents entry of carrier 32' into the lateral track run in the manner already described. When carrier 32' reaches its storage position, carrier 34' will be at the junction of track run 10' and lateral track run 12'. In the manner already described, bar 18' will divert the carrier into track run 12'. The carrier 34' will continue in track run 12' to its storage position, the partition pivoting about carrier 32 to accommodate this movement.

Figure 6:
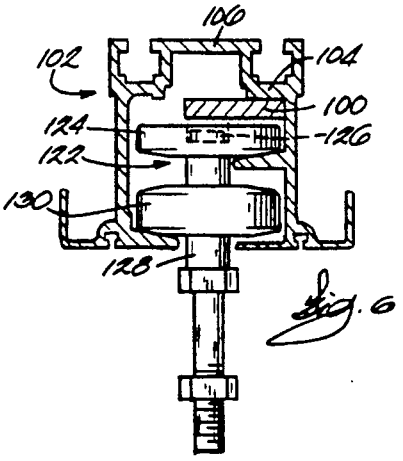
FIG. 6 is a view of an alternative track and carrier arrangement used in an alternative embodiment, partially in section.
Figure 7:
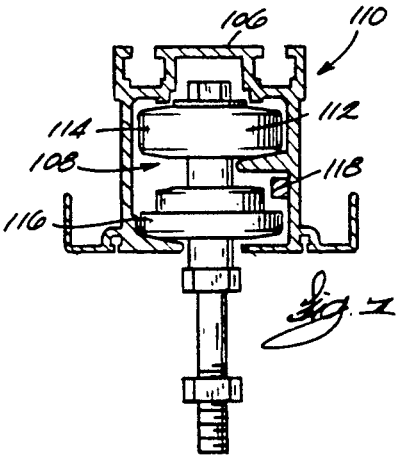
FIG. 7 is a view, partially in section, of the alternative embodiment of FIG. 6, but illustrating the other panel carrier.
Figure 8:
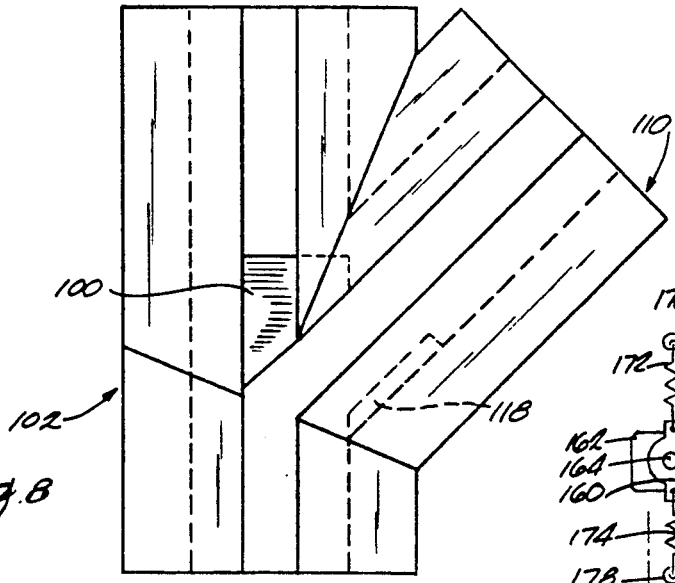
FIG. 8 is a plan view of the area where the lateral track run opens into the main track run usable with the alternative embodiments of FIGS. 6 and 7.

The embodiment of FIGS. 6, 7 and 8 is to illustrate that the projection in the carriers which operates to divert the selected carriers into the lateral track runs can be a part of the disc itself.

In this embodiment, diverter bar 100 is fixed in track run 102, but at a lower level than was bar 16. Here, bar 100 is attached to the lowermost portion 104 of shaped top wall 106. Carrier 108 is shown in track run 110 after it has been diverted by bar 100. Carrier 108 has an upper disc 112, the outer wall 114 of which extends upwardly in cylindrical fashion to provide an enlarged upper portion as compared to the carrier discs already described and to be described. This enlarged upper portion provides a projection which will engage bar 100 and will be diverted thereby to direct carrier 108 into lateral track 110. Disc 116 retains the cut-out portion 120 to clear bar 118 in lateral track 110.

Carrier 122 is illustrated in track run 102. Upper disc 124 has a reduced axial dimension and head 126 of bolt 128 is recessed in disc 124 so that the disc and the bolt clear bar 100 allowing carrier 122 to continue along track run 102. Disc 130 has a full thickness in an axial direction, as did disc 38 so that it will engage bar 118, preventing carrier 122 from entering lateral track run 110.

The preferred embodiment has been described in connection with movement into and out of storage. The same system of diverters in main track runs and blocking bars in lateral track runs can also be used in applications where the lateral track runs are operable runs for hanging particular walls in a described location. This system can be used to insure that only desired walls, for example, fire-rated or acoustical, can be moved into certain operative positions.

Figure 9:
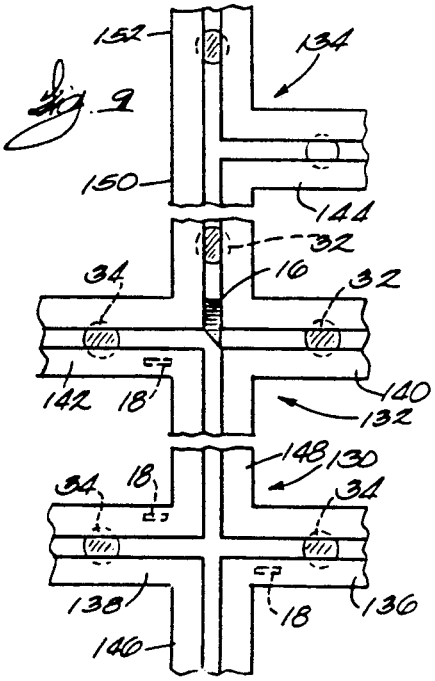
FIG. 9 is a plan view of a portion of a track grid system, illustrating the use of this invention in partition deployment.

FIG. 9 illustrates such an arrangement. In this figure, carriers 32 and 34 have been shown schematically by shaded circles superimposed on main track runs and lateral track runs. The track runs form two cross-overs 130, 132 and a T-section 134 for illustrative purposes. Carriers 32 and 34 will have the configurations of FIGS. 2 and 3 and deflector bar 16 and obstructing bars 18 are placed in various positions for illustrative purposes. The lateral track runs 136, 138, 140, 142, and 144 are at right angles to main track runs 146, 148, 150 and 152.

By varying the types of carriers attached to the operable walls, automatic selection of operable walls for positioning is possible. In FIG. 9, only walls with carriers 34 can enter lateral runs 136, 138, bars 18 preventing entry of carrier 32. At cross-over 132, only panels with carriers 34 can enter lateral run 142, again bars 18 preventing entry of carriers 32. Only panels with carriers 32 will be capable of moving into lateral run 140 and continuing past cross-over 132 for entry to lateral run 144 or continued movement through track run 152.

Figure 10:
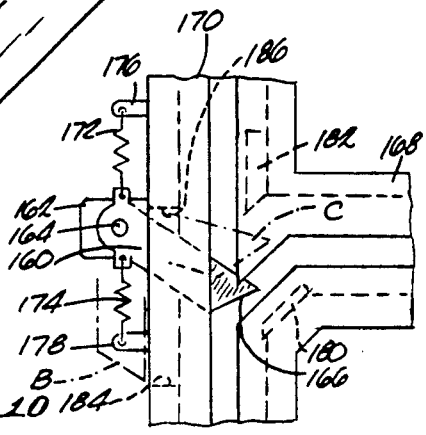
FIG. 10 is a plan view of a portion of a track grid illustrating another embodiment of this invention.

FIG. 10 illustrates yet another embodiment. In this embodiment, a pivotal arm 160 extends through the track wall and is supported on ledge 162 by pin 164. The arm is free to pivot about pin 164 between the full line position A and the dotted line positions B and C. In position A, it will engage the uppermost disc or bolt end and, by virtue of angled face 166, divert that carrier into track 168. The arm is moved by the carrier further into the track to position C and divert the carrier into track 168. Diverted carriers, or panels, may have been moved into storage by means of other track sections. When these diverted channels are moving from storage along track section 170, the arm 160 will be engaged by the upper disc and is free to be moved to position B, by the disc or bolt, allowing the carrier to pass. Tension springs 172 and 174 are mounted between arm 160 and supports 176 and 178 and cooperate to bias arm 160 into position A, which is its neutral or normal position. The opening through which the arm extends into track 170 is bounded by edges 184 and 186. Edge 186 functions as a stop for arm 160 to establish position C at which the carrier is diverted. Track sections 168 and 170 are provided with bars 180 and 182 to prevent unwanted carriers from entering track sections 168 and 170, respectively.

The possible combinations and operational set-ups are virtually without limit, but can be achieved in a simple and effective manner. Panels may be provided only with carriers 32 or 34, or as in a storage application with one carrier 32 and one carrier 34.

Although this invention has been illustrated and described in connection with particular embodiments thereof, it will be apparent to those skilled in the art that various changes and modifications may be made therein without departing from the spirit of the invention or from the scope of the appended claims.

We claim:

1. An operable wall system comprising, in combination, an operable wall storage area in which operable walls can be stored and from which said operable walls can be deployed for use, a first track run connected to said operable wall storage area, lateral track runs connected to and extending laterally of said first track run, said lateral track runs opening into said first track run, a plurality of carriers each including at least one disc and including means for attachment to an operable wall, means on said first and lateral track runs defining disc support surfaces, said discs engaged on and movable relative to said track runs on said support surfaces, means on selected ones of said carriers defining a projection extending above and movable with said selected ones of said carriers in said tracks, diverter means supported in said track runs adjacent selected areas at which said lateral track runs open into said first track run and positioned in the path of movement of said projection on said carriers for engaging said projection and diverting carriers with said projections into said lateral track runs and so that carriers without said projections move past said diverter means and continue along said first track run, one of the discs in the carriers having said projection having a cut-out portion, and obstruction means supported in said lateral track runs adjacent selected area at which said lateral track runs open into said first track run and positioned in the path of movement of said cut-out portions of said discs for preventing movement of discs without said cut-out portions into said lateral track runs while permitting discs with said cut-out portions to move into and along said lateral track runs.

2. An operable wall system comprising, in combination, a track grid system including first track runs and second track runs extending laterally from said first track runs, said second track runs opening into said first track runs, a plurality of operable walls, each of said operable walls being supported by two carriers, each of said carriers including bolt means and first and second discs spaced vertically on said bolt means, and means for supporting said discs for rotation relative to said bolt means, each of said track runs including wall means defining an upper wall, depending side walls, and lower flange means defining a slot, said bolt means extending through said slot for attachment to and support of said operable walls, a diverter in said first track run adjacent said upper wall, said diverter positioned in the area at which said second track run opens into said first track run and having an angled surface facing into a direction of movement of said carriers and angling toward said second track run, an upwardly extending projection on one of said carriers, said diverter being positioned in the path of movement of said projection so that when said projection engages said angled diverter surface said one carrier is diverted into said second track run, an obstruction attached to one of said side walls and extending inwardly into said second track run in the area at which said second track run opens into said first track run, one of the discs in the one carrier having said diverter engaging projection having a cut-out portion and said obstruction in said second track run being in the path of travel of said cut-out portion of said one disc so that said one carrier is movable past said obstruction without interference therefrom, the other of said carriers attached to said operable wall terminating below the level of said diverter, and a disc in said other carrier in a position corresponding to the position of said one disc in said first mentioned carrier with said cut-out portion and having a portion thereof positioned to engage said obstruction in said second track run so that said other carrier is prevented from entering said second track run.

3. The operable wall system of claim 2 wherein both the first and second discs in said carrier without said upwardly extending projection have the same configuration, and wherein one of the first and second discs in said carrier with said diverter engaging projections has the same configuration as the first and second discs in said carrier without said diverter engaging projection and the other disc thereof has said cut-out portion.

4. An operable wall system comprising, in combination, first track runs, lateral track runs connected to and extending laterally of said first track runs, said lateral track runs opening into said first track runs, a plurality of carriers each including two vertically spaced discs and including means for attachment to an operable wall, means on said first and lateral track runs defining disc support surfaces, said discs engaged on and movable relative to said track runs on said support surfaces, means on selected ones of said carriers defining a projection extending above the uppermost disc and movable with said selected carriers in said tracks, means on selected ones of discs defining cut-out portions as compared to others of said discs, diverter means supported in said track runs adjacent selected areas at which said lateral track runs open into said first track runs, said diverter means comprising a diverter above the uppermost of said discs and positioned in the path of movement of said projection on said carriers for engaging said projection and diverting carriers with said projections into said lateral track runs and so that carriers without said projections move past said diverter and continue along said first track run, obstruction means supported in said lateral track runs adjacent selected areas at which said lateral track runs open into said first track run and positioned in the path of movement of said cut-out portions of said discs for preventing movement of discs without said cut-out portions into said lateral track runs while permitting discs with said cut-out portions to move into and along said lateral track runs

5. The operable wall system of claim 4 wherein said lateral track runs include wall means defining the interior of said lateral track runs, said obstruction means in said lateral tracks comprise an obstruction extending from said wall means into said lateral track runs, selected ones of said discs include a dimensionally reduced portion relative to the remainder of said disc to provide said cut-out portions, and said obstructions are positioned in the path of movement of said dimensionally reduced portion.

6. The operable wall system of claim 4 including bolt means and means in each of said carriers for supporting said discs on said bolt means for rotation about said bolt means as said carrier is moved through said track runs, wherein said projections extend upwardly as an extension of said bolt means in selected ones of said carriers, and wherein selected others of said carriers are without said projections, and in said carriers without said projections said discs have the same configuration.

7. The operable wall system of claim 6 wherein said lateral track runs include wall means defining the interior of said lateral track runs, said obstruction means in said lateral track runs comprise an obstruction extending from said wall means into said lateral track runs, the discs in said carrier with said upward projection are characterized in that one of said discs has a dimensionally reduced portion relative to the remainder of said discs, and said obstruction is positioned in the path of movement of said dimensionally reduced portion.

8. An operable wall system comprising, in combination, first track runs, lateral track runs connected to and extending laterally of said first track runs, said lateral track runs opening into said first track runs, a plurality of carriers each including at least one disc and including means for attachment to an operable wall, means on said first and lateral track runs defining disc support surfaces, said discs engaged on and movable relative to said track runs on said support surfaces, means on selected ones of said carriers defining a projection movable with said selected carriers in said tracks, means on selected ones of discs defining cut-out portions as compared to others of said discs, diverter means supported in said track runs adjacent selected areas at which said lateral track runs open into said first track run and positioned in the path of movement of said projection on said carriers for engaging said projection and diverting carriers with said projections into said lateral track runs and so that carriers without said projections move past said diverter and continue along said first track run, said diverter means including an arm having a first position extending into the path of movement of said projection on said carriers, and means mounting said arm for movement into and out of said position so that in one direction of movement of carriers with said projection said carriers are engaged thereby and diverted and in an opposite direction of movement said carriers with said projection engage said arm and move said arm out of the path of movement of said carrier, and obstruction means supported in said lateral track runs adjacent selected areas at which said lateral track runs open into said first track run and positioned in the path of movement of said cut-out portions of said discs for preventing movement of discs without said cut-out portions into said lateral track runs while permitting discs with said cut-out portions to move into and along said lateral track runs.

9. The operable wall system of claim 8 further including means biasing said arm of said diverter means into said first position.

* * * * *